US008485067B2

(12) United States Patent
Pietras et al.

(10) Patent No.: US 8,485,067 B2
(45) Date of Patent: Jul. 16, 2013

(54) TUBULAR JOINT DETECTION SYSTEM

(75) Inventors: Bernd-Georg Pietras, Wedemark (DE); Martin Liess, Langenhagen (DE)

(73) Assignee: Weatherford/Lamb, Inc., Houston, TX (US)

( * ) Notice: Subject to any disclaimer, the term of this patent is extended or adjusted under 35 U.S.C. 154(b) by 1202 days.

(21) Appl. No.: 10/276,970

(22) PCT Filed: Jan. 16, 2002

(86) PCT No.: PCT/GB02/00182

§ 371 (c)(1),
(2), (4) Date: Jun. 30, 2003

(87) PCT Pub. No.: WO02/059450

PCT Pub. Date: Aug. 1, 2002

(65) Prior Publication Data

US 2004/0026088 A1 Feb. 12, 2004

(30) Foreign Application Priority Data

Jan. 24, 2001 (GB) ..... 0101782.1

(51) Int. Cl.
*E21B 19/16* (2006.01)

(52) U.S. Cl.
USPC ..... 81/57.15; 81/57.24; 81/429

(58) Field of Classification Search
USPC ..... 81/57.15, 57.17, 57.18, 57.33, 57.24, 81/57.21, 429
See application file for complete search history.

(56) References Cited

U.S. PATENT DOCUMENTS

| | | | |
|---|---|---|---|
| 2,459,499 | A | 1/1949 | Castel |
| 2,692,059 | A | 10/1954 | Bolling, Jr. |
| 3,017,621 | A | 1/1962 | Taborsky |
| 3,103,976 | A | 9/1963 | deViries et al. |
| 3,194,313 | A | 7/1965 | Fanshawe |
| 3,273,054 | A | 9/1966 | Cook |
| 3,336,572 | A | 8/1967 | Paull et al. |
| 3,434,046 | A | 3/1969 | Wilson et al. |
| 3,475,038 | A | 10/1969 | Matherne |
| 3,561,811 | A | 2/1971 | Turner, Jr. |
| 3,570,594 | A | 3/1971 | Hamilton |

(Continued)

FOREIGN PATENT DOCUMENTS

| | | |
|---|---|---|
| EP | 0 339 005 | 10/1989 |
| GB | 2 049 518 | 12/1980 |

(Continued)

OTHER PUBLICATIONS

Canadian Office Action, Application No. 2,409,371, dated Oct. 24. 2006.

*Primary Examiner* — Hadi Shakeri
(74) *Attorney, Agent, or Firm* — Patterson & Sheridan, LLP

(57) ABSTRACT

An apparatus for connecting tubulars comprises tongs for gripping the tubulars, having openings which can be aligned to allow tubulars to enter the tongs, and a detection apparatus for detecting the location of a joint between the tubulars. The detection apparatus comprises a set of keys disposed along an axis substantially parallel to the axis of the tubulars, the keys being individually displaceable on contact with the tubulars as the tubulars enter the tongs through the openings. The detection apparatus further comprises a set of sensor means, each arranged to detect displacement of a corresponding key. The position of the joint can then be determined from the displacement of the keys.

6 Claims, 4 Drawing Sheets

U.S. PATENT DOCUMENTS

| | | | | | |
|---|---|---|---|---|---|
| 3,780,815 | A | | 12/1973 | Barron et al. | |
| 3,843,923 | A | | 10/1974 | deVries et al. | |
| 3,881,375 | A | | 5/1975 | Kelly | |
| 3,882,377 | A | | 5/1975 | Kelly | |
| 4,110,688 | A | | 8/1978 | Bailey | |
| 4,120,095 | A | | 10/1978 | Lebourg | |
| 4,140,991 | A | | 2/1979 | Singleton et al. | |
| 4,148,013 | A | | 4/1979 | Finn et al. | |
| 4,202,225 | A | | 5/1980 | Sheldon et al. | |
| 4,214,842 | A | | 7/1980 | Franks | |
| 4,295,527 | A | | 10/1981 | Russe | |
| 4,327,261 | A | | 4/1982 | Sheldon | |
| 4,403,666 | A | | 9/1983 | Willis | |
| 4,528,757 | A | | 7/1985 | McKeehan et al. | |
| 4,565,003 | A | | 1/1986 | McLeod | |
| 4,591,293 | A | * | 5/1986 | Levallois et al. | 405/170 |
| 4,821,814 | A | | 4/1989 | Willis et al. | |
| 4,964,462 | A | | 10/1990 | Smith | |
| 4,979,356 | A | | 12/1990 | Vatne | |
| 5,014,781 | A | | 5/1991 | Smith | |
| 5,054,550 | A | | 10/1991 | Hodge | |
| 5,161,438 | A | | 11/1992 | Pietras | |
| 5,167,173 | A | * | 12/1992 | Pietras | 81/57.15 |
| 5,178,045 | A | * | 1/1993 | Frizot | 81/54 |
| 5,249,208 | A | * | 9/1993 | Ruzga et al. | 81/57.38 |
| 5,361,838 | A | | 11/1994 | Kilgore | |
| 5,390,568 | A | | 2/1995 | Pietras | |
| 5,429,190 | A | | 7/1995 | Kilgore et al. | |
| 5,626,192 | A | | 5/1997 | Connell et al. | |
| 5,720,345 | A | | 2/1998 | Price et al. | |
| 5,750,896 | A | | 5/1998 | Morgan et al. | |
| 5,842,390 | A | | 12/1998 | Bouligny et al. | |
| 6,032,739 | A | | 3/2000 | Newman | |
| 6,253,842 | B1 | | 7/2001 | Connell et al. | |
| 6,318,214 | B1 | | 11/2001 | Buck | |
| 6,360,633 | B2 | | 3/2002 | Pietras | |
| 6,411,084 | B1 | | 6/2002 | Yoo | |
| 6,720,764 | B2 | * | 4/2004 | Relton et al. | 324/235 |
| 6,814,149 | B2 | * | 11/2004 | Liess et al. | 81/57.15 |
| 6,965,230 | B2 | | 11/2005 | Rogers et al. | |

FOREIGN PATENT DOCUMENTS

| | | |
|---|---|---|
| WO | WO 93/18276 | 9/1993 |
| WO | WO 98/32948 | 7/1998 |
| WO | WO 00/45026 | 8/2000 |

* cited by examiner

TUBULAR JOINT DETECTION SYSTEM

CROSS-REFERENCE TO RELATED APPLICATIONS

This application is the National Stage of International Application No. PCT/GB02/00182, filed Jan. 16, 2002 and published under PCT Article 21(2) in English, and claims priority of Great Britain Application No. 0101782.1, filed on Jan. 24, 2001. The aforementioned related patent application is herein incorporated by reference in its entirety.

BACKGROUND OF THE INVENTION

1. Field of the Invention

The present invention relates to operations involving the connection and disconnection of threaded tubular members on a drilling rig.

2. Description of the Related Art

In the construction of oil or gas wells it is usually necessary to prepare extremely long drill pipes or strings. Due to the length of pipe required, sections or stands of pipe are progressively added to the pipe as it is lowered into the well from a drilling platform. In particular, when it is desired to add a section or stand of pipe the string is usually restrained from falling into the well by applying the slips of a spider located in the floor of the drilling platform. The new section or stand of pipe is then moved from a rack to the well centre above the spider. The threaded pin of the section or stand of pipe to be connected is then located over the threaded box of the pipe in the well and the connection is made up by rotation therebetween. An elevator is connected to the top of the new section or stand and the whole pipe string lifted slightly to enable the slips of the spider to be released. The whole pipe string is then lowered until the top of the section is adjacent the spider whereupon the slips of the spider are re-applied, the elevator disconnected and the process repeated.

The first stage of making up the threaded connection normally involves the use of a drill pipe spinner located above the joint between the tubulars. The pin of the section of tubular to be added to the string is introduced into the box at the top of the string of tubulars, and the new section is spun by the spinner so that most of the connection is made under low torque. During this operation the spider holding the string generally provides sufficient reaction torque to prevent the string being rotated as the new joint is screwed in.

To complete the joint a much higher torque is required and it is common practice to use a power tong to provide this. The power tong is located on the platform, either on rails, or hung from a derrick on a chain, and is positioned around the joint once the initial stage of spinning the new tubular is complete. A two tong arrangement is used: an active (or wrenching) tong supplies torque to the section of tubular above the threaded connection, while a passive (or back up) tong supplies a reaction torque below the threaded connection, and prevents it from rotating. Such a tong arrangement is shown in FIG. 1.

It is important to ensure that when the tongs are tightened onto the tubulars, the joint between the tubulars is located between the tongs so that neither tong can tighten onto both tubulars.

Traditionally, the only way to monitor the position of the tubulars and tongs and to ensure that the junction between tubulars is correctly located between the tongs has been for a wellbore operative to stand beside the tongs and confirm by eye that the tubulars are in the correct position. It is desirable to automate the procedure around the head of the wellbore as much as possible so that operatives do not have to stand in this location, as it is a particularly dangerous environment. It is known to use a sensor which is moved axially relative to a pipe connection system to detect the presence of a tool joint. However, such a mechanism can only detect large upsets and is not suitable for detecting couplings between threaded connectors (e.g. in tubing and casing). Furthermore, the mechanism operates slowly, requiring axial movement over a predefined distance.

SUMMARY OF THE INVENTION

According to a first aspect of the present invention, there is provided apparatus for connecting aligned first and second tubulars, comprising:

a first tong for gripping the first tubular;

a second tong, rotatable relative to the first tong, for gripping the second tubular, the first and second tongs having openings which can be aligned to allow tubulars to enter the tongs; and a detection apparatus fixed to one of the tongs adjacent the opening in that tong for detecting the location of a joint between the first and second tubulars;

characterised in that the detection apparatus comprises:

a linear array of sensors aligned with the longitudinal axes of the first and second tubulars, each sensor being individually actuable upon entry of the tubulars into the tongs through the openings depending upon the proximity of a tong surface to the sensor, wherein the position of the joint can be determined from the actuation pattern of the sensors.

Preferably, the detection apparatus comprises a set of keys disposed along an axis which in use is substantially parallel with the axis of the first and second tubulars, the keys being individually displaceable on contact with the tubulars as the tubulars enter the tongs through the openings, and wherein each said sensor is arranged to detect the displacement of a corresponding key.

Each key is preferably substantially L-shaped and arranged so that the short arm of the L-shape can be moved past the corresponding sensor means. The detection apparatus preferably further comprises a casing to which each key is mounted at the distal end of the long arm of the L-shape and arranged so that the short arm of the L-shape extends around the end of the casing, the sensor means being mounted on said end of the casing.

Each key is preferably sprung, and preferably metal, so it returns to its non-displaced position when not in contact with a tubular.

Each sensor means preferably generates a localised magnetic field and detects the displacement of the corresponding key by the change in the magnetic field.

Preferably, the detection apparatus is arranged on one of the tongs and extends across the opening in such a way that the tubulars cannot enter the tongs without contact being made with the detection apparatus. The detection apparatus may be resiliently mounted so that it returns to the position in which it extends across the opening when it is not in contact with a tubular.

The detection apparatus may comprise signal processing means for receiving output signals from each of the sensor means and arranged to determine the relative position of the joint from an analysis of the signals. The signal processing means preferably comprises means for detecting a spatial step change in the output signals and for associating such a step change with an upset in a tubular.

According to a second aspect of the present invention there is provided a detection apparatus for detecting a joint between two tubulars, comprising:

a set of keys disposed along an axis which in use is substantially parallel with the axis of the tubulars, the keys being individually displaceable on contact with the tubulars; and a set of sensor means, each arranged to detect displacement of a corresponding key;

wherein the position of the joint can be determined from the displacement of the keys.

According to third aspect of the present invention there is provided a method of connecting a first tubular to a second tubular, the method comprising:

aligning a wrenching tong having an opening with a back-up tong having an opening;

introducing a first tubular and a second tubular joined by a partially completed joint into the tongs through the aligned openings;

contacting the tubulars in the region of the joint with a detection apparatus as the tubulars enter the joint, the detection apparatus comprising a linear array of sensors disposed along an axis substantially parallel to the axis of the first and second tubulars, each sensor being individually actuable upon entry of the tubulars into the tongs through the openings depending upon the proximity of a tong surface to the sensor;

determining the position of the joint relative to the tongs on the basis of the actuation pattern of the sensors;

adjusting the height of the tongs so that the joint is correctly located between the tongs;

gripping the first tubular with the back-up tong and the second tubular with the wrenching tong; and rotating the wrenching tong relative to the back-up tong so as to rotate the second tubular relative to the first tubular.

Preferably, the detection apparatus comprises a set of keys disposed along an axis substantially parallel to the axis of the first and second tubulars, the keys being displaced by contact with the tubulars to actuate respective sensors.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
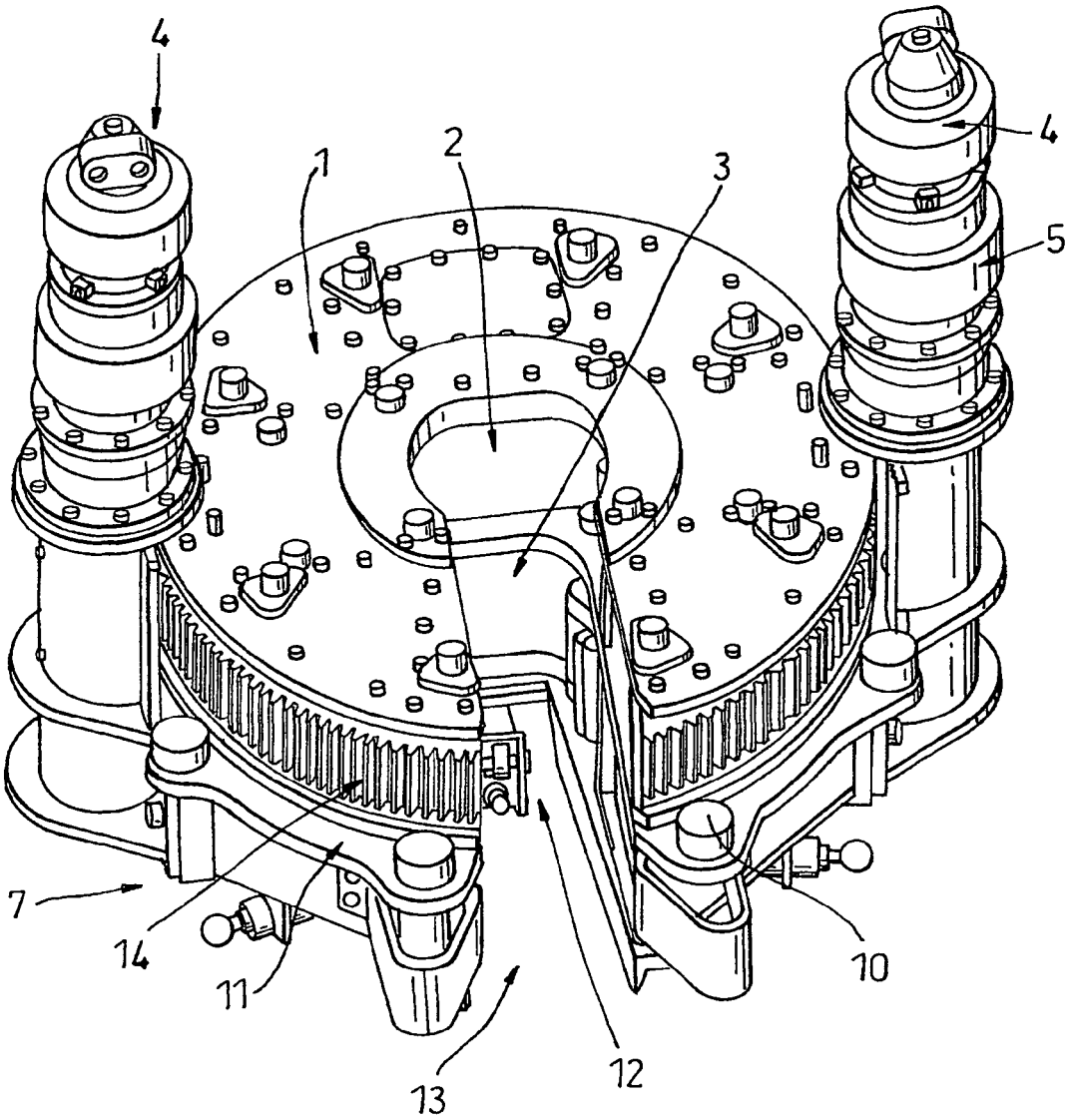
Fig. 1 (Prior Art)
FIG. 1 is a view of an arrangement of a wrenching tong and a back-up tong.

The present invention FIG. 1 shows a known power tong arrangement comprising a wrenching tong 1 and a back-up tong 11. The wrenching tong 1 is generally in the form of a cylinder with an opening 2 through the centre thereof for receiving a stand of drill pipe (not shown), and a recess 3 running from the edge to the opening 2 at the centre.

The back-up tong 11 is located beneath the wrenching tong 1. The back-up tong is generally in the form of a disc with similar dimensions to the wrenching tong 1. The back-up tong is also provided with an opening 12 through the centre and a recess 13 from the edge to the opening at the centre. The opening 12 and recess 13 correspond to the opening 2 and recess 3 of the wrenching tong when the back-up tong 11 and the wrenching tong 1 are correctly aligned. A plurality of guide rollers 10 or other guide elements are spaced around the edge of the wrenching tong 1 in order to maintain the alignment of the wrenching tong 1 with the back-up tong 11.

The back-up tong 11 is provided with two pinion drives 4 arranged opposite each other at the periphery of the disc, equally spaced either side of the opening 12. Each pinion drive comprises a drive motor 5, drive shaft (not shown) and pinion (hidden in FIG. 1 but indicated generally by the numeral 7) attached to the drive shaft. A gear 14 is provided around the periphery of the wrenching tong 1, broken by the recess 3. The gear 14 meshes with the pinions attached to the motors 5 on the back-up tong, so that when the drive motors 5 drive the drive shafts and pinions 7, the wrenching tong 1 rotates relative to the back-up tong 11. The angle of rotation is limited by the recess 3 of the wrenching tong 1.

Two clamping jaws (not shown) are located inside each of the wrenching tong 1 and back-up tong 11 as illustrated in FIG. 1. These are hydraulically driven for clamping the drill pipe stand in place in the centre of the wrenching tong. The hydraulic power supply may be provided by hoses (not shown).

Figure 2:
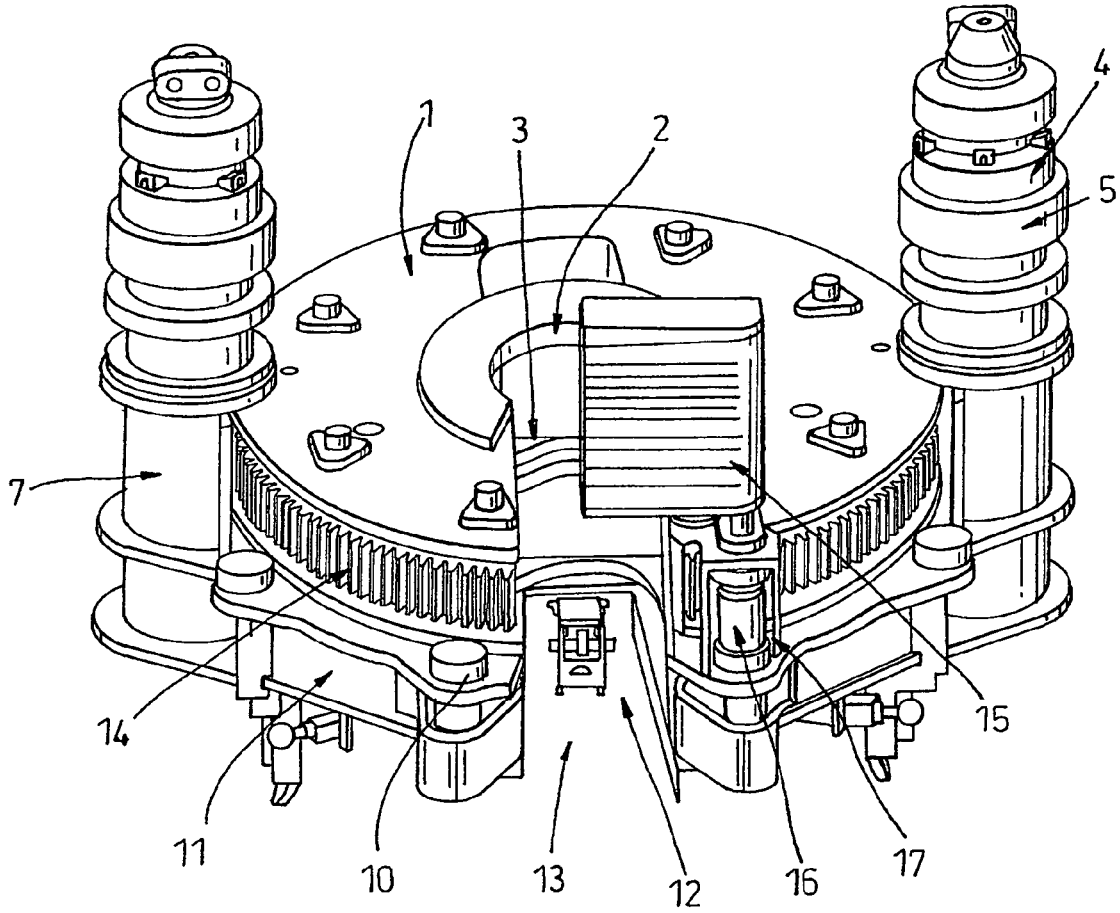
FIG. 2 is a view of the tong of FIG. 1 with a detection apparatus in place.

FIG. 2 shows the same arrangement of tongs as FIG. 1, with the addition of a detection apparatus 15. The detection apparatus 15 is pivotally mounted on the backup tong 11 via a shaft 16 attached to the detection apparatus running through a bracket 17 attached to the back-up tong, so as to form a flap extending across the recess 3 which must be pushed aside by tubulars entering the tong. The flap is spring mounted so that, in the absence of tubulars pushing it aside, it returns to the position extending across the recess 3, as shown in FIG. 2.

Figure 3:
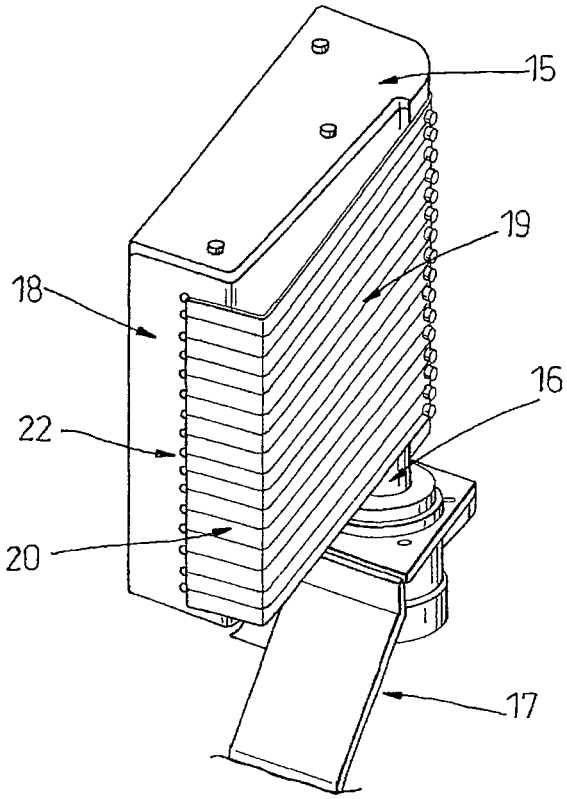
FIG. 3 is a detailed view of the detection apparatus of FIG. 2.
Figure 4:
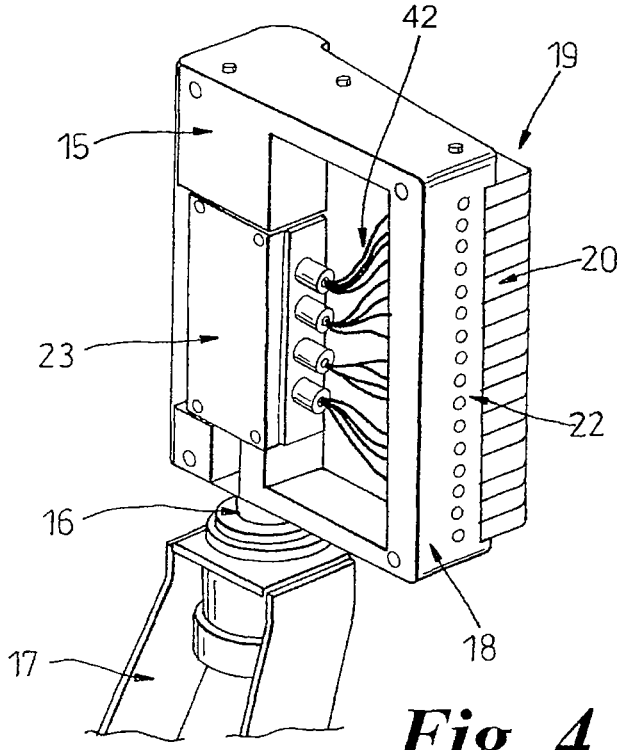
FIG. 4 is another view of the detection apparatus of FIG. 3.

FIGS. 3 and 4 show the detection apparatus in more detail. The detection apparatus 15 consists of a casing 18, to which is mounted a row of metal keys 19. Each key 19 is "L" shaped and elongate and is sprung mounted at one end to the casing 18 so that its free end 20 can be deflected across the end of the casing 18 from the normal, non-deflected position.

A set of sensors, shown generally at 22, is provided along the end of the casing 18 so that the free end of each key 19 passes across in front of the corresponding sensor when the key 19 is deflected. Each sensor 22 generates a localised magnetic field, and detects changes in that magnetic field as the free end 20 of the corresponding metal key 19 passes in front of it. An actuation signal from each sensor 22 is returned to a central analysis system 23 via wires 42, so that the detection apparatus is able to give an overall indication of which of the keys 19 have been displaced. The central analysis system 23 is triggered by actuation of any one of the sensors 22 to detect the set of keys which is actuated in a predefined time window following triggering. The central analysis system 23 is also connected to an automatic control system (not shown) for controlling the height of the tong 1, 11.

In use, as explained at the beginning of this document, a string of tubulars is restrained from falling into the well by applying the slips of a spider (not shown) located in the floor of the drilling platform. In order to add a new stand of tubulars, the new stand is moved from a rack nearby until it is correctly aligned above the top of the stand held in the spider. The new stand is now spun by a drill pipe spinner (not shown) located above the spider, so that the threaded pin screws down into the threaded box at the top of the drill pipe string.

In order to complete the joint, the power tong 1, 11 is now moved into position. The recesses 3, 13 are aligned and the tong is pushed forward so as to encircle the tubulars. The detection apparatus 15 is pushed aside by the tubulars, so that it pivots on the shaft 16, as the tubulars enter the tong, and once the tubulars are past the detection apparatus 15 it swings back into its original position.

Figure 5:
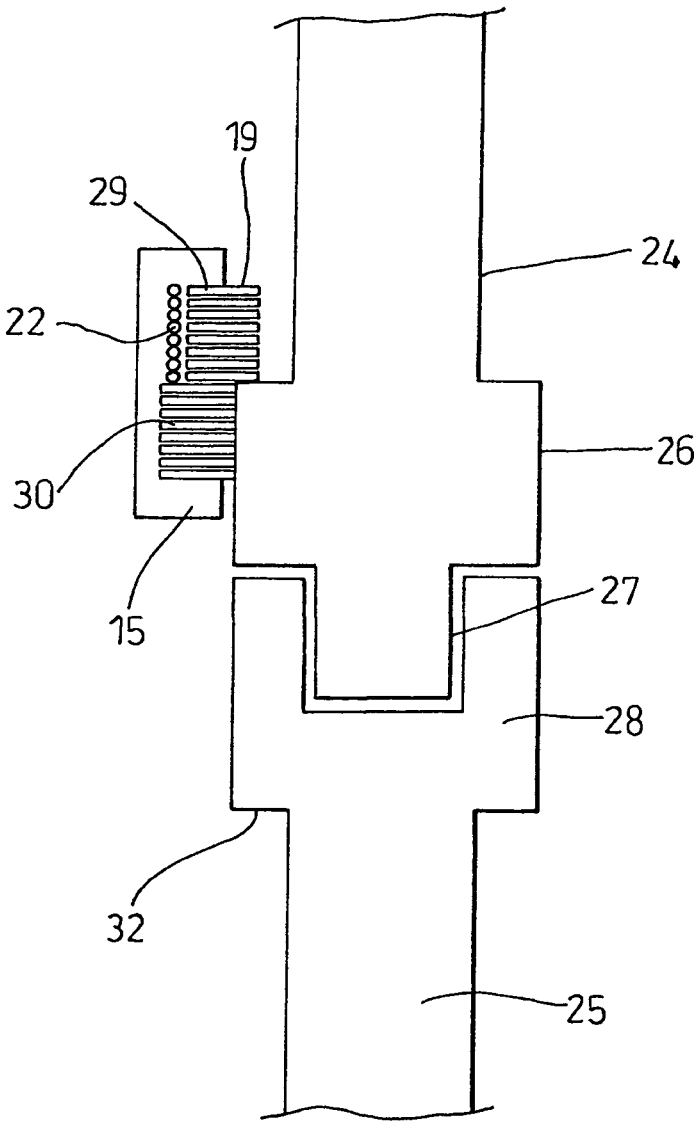
FIG. 5 is a view of the detection apparatus of FIG. 3 as it is contacted by a joint between two tubulars.

The arrangement of the detection apparatus 15 at the moment of contact with the tubulars 24, 25 is shown in FIG. 5. The thickness of the tubulars varies near the joint: the higher tubular 24 has a thicker portion 26 (designed to be gripped by the wrenching tong) just above the pin 27. Similarly, the box 28 of the lower tubular 25 is thicker than the rest of the tubular 25. The edge of the tubulars thus presents a stepped profile to the detection apparatus 15 as it makes contact. The steps 31, 32 in the profile are known as "upsets".

This stepped profile causes only some of the keys 19 to be displaced. The thicker portion 26, 28 of the joint contacts some of the keys 30 and deflects them so that they move past the sensors 22. The maximum deflection of these keys 30 is less than the variation in the thickness of the tubulars, so that they become fully deflected before the other keys 29 are contacted by the thinner portion of the tubular 24. As soon as the first of the keys 30 passes the sensor 22 the analysis system 23 is triggered to record the positions of all of the keys within a predetermined time window (for example one second).

As the tubulars 24, 25 are pushed further into the tong 1, 11 the detection apparatus 15 is swung back out of the way by the pressure exerted by the thicker part 26, 28 of the tubulars on the keys 30. The rest of the keys 29 are not deflected as the tubulars 24, 25 move past the detection apparatus 15. The analysis system 23 can determine the location, relative to the wrenching tong 1, of the upset 31. Since the distance from the upset 31 to the joint is known, this enables the position of the joint relative to the tong 1, 11 to be determined.

Once the tubulars 24, 25 are past the detection apparatus 15 it swings back into position, and the keys 19 return to their original positions. The relative vertical positions of the tong 1, 11 and the tubulars are now known, and the height of the tong is adjusted by a known amount so that the wrenching tong 1 surrounds only the upper tubular 24 and the back-up tong 11 surrounds only the lower tubular 25. The lower tubular 25 is now gripped in the back-up tong 11 by jaws (not shown), and the higher tubular 24 by the wrenching tong 1. The final torque is now applied to the joint as the upper tubular 24 is rotated relative to the lower tubular 25 by the wrenching tong 1.

The tubulars 24, 25 are then released by the tongs and the wrenching tong 1 rotated so that the recesses 3, 13 are again in alignment. The tongs are then moved away from the tubulars. As the tubulars contact the detection apparatus 15, it is pivoted in the opposite direction by the pressure of the tubulars to allow them to move past it. Once the tubulars are clear of the detection apparatus 15 it swings back to its original position. The whole string, including the new stand, is then lowered into the wellbore and the whole process is repeated, as described above.

In another embodiment, the power tong 1, 11 is moved into position before the upper tubular 24 has been spun into the lower tubular 25. The detection apparatus 15 detects the position of the upset 31 as described above. The length of the thicker portion 26 of the upper tubular and the length of the thread are known, and this enables the location of the top of the lower tubular 25 to be determined. The tong can then be moved into the correct position for the back-up tong 11 to grip the lower tubular before the spinning operation takes place. The back-up tong 11 can therefore be used to provide reaction torque to the drill pipe spinner.

It will be appreciated that modifications to the embodiments described above will still fall within the scope of the invention. For example, a wrenching tong having a gear therearound has been described, but any form of power tong may be used. Indeed, the detection apparatus can be used to detect the vertical position of a tubular at any point above the wellbore, and need not be limited to use with a power tong.

The method described above may also be used to detect the vertical position of a tubular at any point of the cycle, and not just immediately before or after the spinning of the tubular by a drill pipe spinner.

It will also be appreciated that use of the invention is not limited to oil rigs. For example, large numbers of tubulars are kept in storage yards and the invention may be useful when moving tubulars around such storage yards.

Furthermore, the detection means has been described as detecting whether or not the keys have been depressed using a magnetic field, but any suitable detection method can be used.

Other detection apparatus can be envisaged which do not use deflectable keys, including a linear array of magnetic or optical proximity sensors which detect the surface of a joint directly.

While the foregoing is directed to embodiments of the present invention, other and further embodiments of the invention may be devised without departing from the basic scope thereof, and the scope thereof is determined by the claims that follow.

The invention claimed is:

1. A method of connecting a first tubular to a second tubular, the method comprising:

aligning a wrenching tong having an opening with a back-up tong having an opening;

introducing a first tubular and a second tubular joined by a partially completed joint into the tongs through the aligned openings, wherein the first and second tubulars are introduced laterally relative to a longitudinal axis of the tubulars through the aligned openings;

contacting the tubulars in the region of the joint using a detection apparatus as the tubulars enter the tongs, thereby causing the detection apparatus to generate an actuation pattern, wherein the detection apparatus comprising a linear array of sensors disposed along an axis substantially parallel to the axis of the first and second tubulars, each sensor being individually actuatable upon entry of the tubulars into the tongs through the openings depending upon the proximity of a tong surface to the sensor;

determining the position of the joint relative to the tongs on the basis of the actuation pattern of the sensors;

adjusting the height of the tongs so that the joint is correctly located with respect to the tongs;

gripping the first tubular with the back-up tong and the second tubular with the wrenching tong; and rotating the wrenching tong relative to the back-up tong so as to rotate the second tubular relative to the first tubular.

2. A method of connecting a first tubular to a second tubular on a rig, the method, comprising:

providing a first tong and a second tong on the rig;

aligning an opening of the first tong with an opening of the second tong;

introducing a first tubular and a second tubular joined by a partially completed joint into the tongs through the aligned openings;

contacting the tubulars in the region of the joint using a detection apparatus as the tubulars enter the tongs;

determining a position of the joint relative to the tongs;

adjusting a height of the tongs so that the joint is correctly located with respect to the tongs;

gripping the first tubular with the first tong and the second tubular with the second tong; and rotating the second tong relative to the first tong so as to rotate the second tubular relative to the first tubular.

3. The method of claim 2, wherein the detection apparatus comprises a plurality of sensors individually actuatable upon entry of the tubulars into the tongs through the openings.

4. The method of claim 3, wherein the position of the joint is determined from the actuation pattern of the plurality of sensors.

5. The method of claim 2, wherein a plurality of sensors are arranged in a linear array along an axis substantially parallel to the axis of the first and second tubulars.

6. The method of claim 2, wherein a plurality of sensors are actuated when tubulars enter the tongs and are based on the proximity of tong surface to the plurality of sensors.

* * * * *

UNITED STATES PATENT AND TRADEMARK OFFICE

CERTIFICATE OF CORRECTION

PATENT NO. : 8,485,067 B2
APPLICATION NO. : 10/276970
DATED : July 16, 2013
INVENTOR(S) : Pietras et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1020 days.

Signed and Sealed this
Eighth Day of September, 2015

Michelle K. Lee

Michelle K. Lee
*Director of the United States Patent and Trademark Office*